United States Patent [19]

Yamamoto et al.

[11] Patent Number: 4,743,942

[45] Date of Patent: May 10, 1988

[54] MAGNETIC DEVELOPER CONVEYING DEVICE

[75] Inventors: Akira Yamamoto, Tokyo; Haruhisa Honda, Yokohama, both of Japan

[73] Assignee: Canon Kabushiki Kaisha, Tokyo, Japan

[21] Appl. No.: 94,030

[22] Filed: Aug. 31, 1987

Related U.S. Application Data

[63] Continuation of Ser. No. 938,446, Dec. 5, 1986, abandoned.

[30] Foreign Application Priority Data

Dec. 10, 1985 [JP] Japan ..... 60-275956

[51] Int. Cl.[4] ..... G03G 15/09

[52] U.S. Cl. ..... 355/3 DD; 355/14 D; 118/657; 118/658

[58] Field of Search ..... 355/3 DD, 3 DR, 4, 14 D; 118/656, 657, 658, 623; 335/303, 304, 305

[56] References Cited

U.S. PATENT DOCUMENTS

| | | | |
|---|---|---|---|
| 4,244,322 | 1/1981 | Nomura et al. | 118/658 |
| 4,509,031 | 4/1985 | Sakata et al. | 355/3 DD |
| 4,557,582 | 12/1985 | Kan et al. | 355/3 DD |
| 4,558,294 | 12/1985 | Yamashita | 355/3 DD |
| 4,563,978 | 1/1986 | Nakamura et al. | 355/3 DD |
| 4,610,531 | 9/1986 | Hayashi et al. | 355/3 DD |
| 4,637,706 | 1/1987 | Hosoi et al. | 355/3 DD |
| 4,638,760 | 1/1987 | Nakamura et al. | 355/3 DD |
| 4,640,808 | 2/1987 | Okumura et al. | 355/3 DR |

FOREIGN PATENT DOCUMENTS

| | | | |
|---|---|---|---|
| 3226978 | 3/1983 | Fed. Rep. of Germany . | |
| 171804 | of 1982 | Japan . | |
| 72162 | 5/1982 | Japan | 118/658 |

OTHER PUBLICATIONS

Patent Abstracts of Japan, vol. 9, No. 120 (P-358)[1843], May 24, 1985.

*Primary Examiner*—A. C. Prescott
*Assistant Examiner*—Ed Pipala
*Attorney, Agent, or Firm*—Fitzpatrick, Cella, Harper & Scinto

[57] ABSTRACT

A device for conveying a magnetic developer, includes a non-magnetic sleeve for carrying the magnetic developer, a resin magnet stationarily disposed in the sleeve, the magnet being of a mixture of a resin material and a magnetic material, and extending in a direction of a length of the sleeve, the magnet having first and second magnetic field generating portions, first and second magnetic members disposed outside the sleeve extending in the direction of the length of the sleeve, wherein the first and second magnetic members are spaced apart from each other and are so disposed that a magnetic force applied to the magnet by a magnetic force between the first magnetic field generating portion and the first magnetic member reduces a resultant force to the magnetic by gravity and by a magnetic force between the second magnetic field generating portion and the second magnetic member.

20 Claims, 2 Drawing Sheets

MAGNETIC DEVELOPER CONVEYING DEVICE

This application is a continuation of application Ser. No. 938,446 filed Dec. 5, 1986 now abandoned.

FIELD OF THE INVENTION AND RELATED ART

The present invention relates to a device for conveying a magnetic developer, which is applicable to a recording apparatus such as a copying machine, a printer, a laser recording apparatus and display device. The device according to the present invention is most suitable to a developing apparatus and a cleaning device for cleaning an image bearing member for removing the developer therefrom.

The most typical magnetic developer conveying device is found in a developing apparatus or in a cleaning device used in a recording apparatus.

In such an apparatus, a structure comprising an endlessly movable sleeve of non-magnetic material and a magnet disposed therein for producing a magnetic field wherein one or both of the sleeve and the magnet are relatively rotated, is adopted as a means for conveying the developer for developing a latent image or as a means for removing the developer remaining on the image bearing member such as a photosensitive member.

As for the magnet, the structure is employed wherein small pieces of magnets are bonded on a metal core, as disclosed in U.S. Pat. No. 4,557,582, which has been assigned to the assignee of the present application.

As for the developer, one component magnetic developer or two component developer which is a mixture of magnetic particles and toner particles, is used since then the developer carried on the non-magnetic sleeve surface can be controlled by the magnetic field provided by the inside magnet. The magnetic developers are in the form of powder and have fluidity. In order to achieve the desired developing or cleaning operation, it is preferable that the developer is formed into a layer of a regulated thickness, or that the developer is stably collected into a developer collecting container.

As an example of regulating a thickness of a one component magnetic developer layer, a blade of magnetic material is used, as disclosed in U.S. Pat. Nos. 4,386,577, 4,391,512, 4,511,239 and 4,297,970. As an example of regulating the thickness of two component developer wherein the magnetic particles are confined within a container, there is a blade of magnetic material disposed downstream of a magnetic pole, as disclosed in U.S. Pat. Nos. 4,548,489 and 4,579,082. As for the collection of the developer, a magnetic member is used at the collecting portion, as disclosed in U.S. Pat. No. 4,563,978. In order to improve the collection, a proposal has been made in U.S. Ser. No. 911,765 filed on Sept. 26, 1986, which has been assigned to the assignee of this application. As an example of providing a magnetic member adjacent a blade, there are U.S. Pat. No. 4,244,322 and U.S. Ser. No. 618,558 filed on July 8, 1984.

Thus, it will be understood that for various purposes, a magnetic member is disposed adjacent or in contact to the surface of the non-magnetic sleeve.

SUMMARY OF THE INVENTION

Recently, in order to meet the demand for reduction of the size, weight and cost of the apparatus, a magnet formed integrally by a resin material and magnetic powder mixture, attracts attention. An example of this is disclosed in U.S. patent application filed on Oct. 1, 1986 which has been assigned to the assignee of this application claiming the Conventional Priorities from Japanese Patent Application Nos. 221495/1985 and 221496/1985. In putting the magnet of this type into practical use, the inventors have found problems which are not known. One of the problems is that when the magnet of this type, that is, a so-called plastic or resin magnet, is employed in the developing apparatus and the cleaning device, insufficient development and cleaning are observed, more particularly, the image density of the developed image varies along the length of the magnet, that is, the density at the central portion is different from that adjacent the end areas. Another problem is the occurrence of vibration of the apparatus.

The inventors have made considerable investigations to find the cause of those problems and have determined that the magnetic field provided by the magnet (inside magnetic field generating means) varies significantly in the operating portion for the development or cleaning. It has further been determined that there is a portion wherein the variation is large and a portion wherein the variation is small, as a result of further investigation about the operating portions.

The inventors have finally found that the resin magnet itself is bent or flexed to a certain extent and concluded that the bending is caused by the magnetic member disposed around the non-magnetic sleeve as described above. The present invention is based on the new finding of the problems and causes of the problems, which are significant in practically using a magnet of this type.

The problems are not known and are recognized for the first time by the inventors.

According to the inventors' analysis, the bending, deflection or deformation of the magnet is caused by the magnetic force produced between the outside magnetic member and the inside resin magnet, more particularly, the resin magnet is attracted toward the magnetic member by the magnetic force so that the resin magnet itself deforms.

It is, therefore, an object of the present invention to provide a magnetic developer conveying device wherein the deformation of the magnet is effectively prevented, so as to allow the desirable developing or cleaning operation or the like.

According to an embodiment of the present invention, the deforming magnetic force is reduced by a balancing magnetic member or members.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
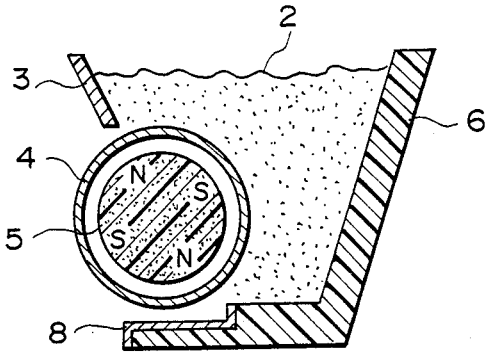
FIG. 1 is a sectional view of a developing apparatus incorporating the magnetic developer conveying device according to an embodiment of the present invention.

Referring to FIG. 1, there is shown a developing apparatus incorporating a magnetic developer conveying device according to an embodiment of the present invention. The developing apparatus comprises a sleeve 4 of non-magnetic material having a surface which is closely opposed to an unshown latent image bearing member in the form of a drum to develop the latent image thereon. A magnet roll 5 is disposed inside the non-magnetic sleeve 4 coaxially with the sleeve 4 in the manner that a uniform clearance is maintained between the inside surface of the non-magnetic sleeve 4 and the magnet roll 5. The magnet roll 5 is fixed to a frame of the apparatus at both longitudinal ends thereof. The magnet roll 5 functions as a means for producing a magnetic field. The magnet roll 5 in this embodiment is made by dispersing ferrite in nylon resin and properly directing magnetic poles. The present invention is particularly suitable to the magnet roll which has been integrally formed by the resin. The magnet roll 5 and the non-magnetic sleeve 4 are relatively rotatable about the common axis.

At a left upper portion of the non-magnetic sleeve 4 in this Figure, a blade 3 of a magnetic material is provided which has a free end spaced from the outer surface of the non-magnetic sleeve 4 with a predetermined clearance. The magnetic blade 3 functions as means for regulating a thickness of a developer layer formed on the sleeve 4 surface and extends along the sleeve and the magnet roll including the central portion thereof. A magnetic attraction force produced between the magnetic blade 3 and the magnet roll 5 is effective to attract an excess amount of the developer from the developer deposited on the non-magnetic sleeve 4 by the magnet roll 5, so that a proper amount of the developer is carried on the sleeve 4 to a developing station where the sleeve 4 is opposed to the latent image bearing member.

Figure 2:
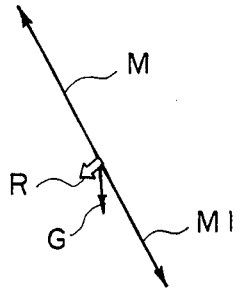
FIG. 2 illustrates forces applied to the magnet in the apparatus of FIG. 1.

Adjacent the bottom of the non-magnetic sleeve 4, that is, at a position radially opposite to the magnetic blade 3, a correction or balancing magnetic member 8 is mounted to the bottom of the opening of the container of a plastic or resin material for containing the developer 2. The correcting magnetic member 8 has a width which is larger than the width of the magnetic pole (N) which is opposed to the bottom of the opening. The correcting magnetic member 8 extends along the length of the sleeve and the roll including the central portions thereof. By the provision of the correcting member 8, the forces applied to the magnetic roll 5, namely, the attraction force M between the magnetic blade 3 and the magnet roll 5, the gravity G to the magnet roll 5 and the attraction force M1 between the correcting member 8 and the magnet roll 5, are substantially balanced as shown in FIG. 2, since the resultant vector R is substantially zero. The correcting member 8 has a surface of magnetic material positioned away from the blade 3 by about 180 degrees with respect to the axis of the sleeve 4.

The numerical data of this embodiment will now be described. Each of the magnetic poles shown in FIG. 1 of the magnet roll 5 provides 650±80 Gausses. The outer diameter of the magnet roll 5 is 18 mm; the weight thereof is 180 g. The magnetic blade 3 is directed to the N pole of the magnet roll 5 with a clearance of 2.2 mm from the surface of the sleeve 4. The distance from the correcting member 8 to the magnet is about 2.8 mm. Under those conditions, the maximum deformation of the magnet roll 5 is not more than 0.05 mm. With such a deformation, the variation in the magnetic field at the developing station is not more than 10 Gausses. When the correcting member 8 is removed from the structure of this embodiment, the deformation is 0.15 mm, and the variation in the magnetic field is 60 Gausses. Thus, it has been confirmed that significant improvement is provided by the correcting member 8.

The correcting member 8 is further effective to reinforce the container 6 of a resin material. The correcting member 8 is disposed opposed to the bottom clearance of the container 6.

The developer is a magnetic developer and may be one component magnetic toner or two component developer containing magnetic particles.

Figure 3:
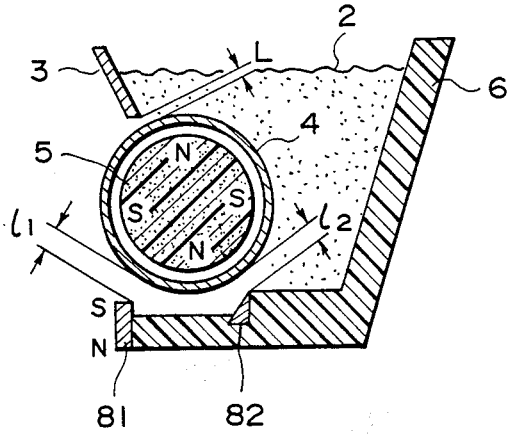
FIG. 3 is a sectional view of a developing apparatus incorporating a magnetic developer conveying device according to another embodiment of the present invention.
Figure 4:
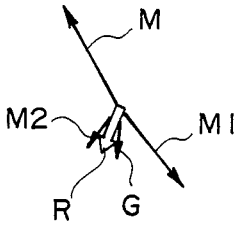
FIG. 4 illustrates forces applied to the magnet in the apparatus shown in FIG. 3.

FIG. 3 illustrates a second embodiment of the present invention, wherein two correcting magnetic members 81 and 82 are employed, as contrasted to the first embodiment. In this embodiment, the distances l1 and l2 between the non-magnetic sleeve 4 and the correcting members 81 and 82, are set to be larger than the distance L between the magnetic blade 3 and the non-magnetic sleeve 4. However, it is preferable that the distances l1 and l2 are not more than 3 mm in order to provide sufficient magnetic attraction. Due to the distance relations, the correcting magnetic members 81 and 82 function only as a means for preventing the deformation or deflection of the magnet roll 5 but do not have the function of regulating the developer.

Where a plurality of the correcting magnetic members are used, as in this embodiment, the influence, to the intended function, of the errors in the dimensions and positions of those members, is reduced, so that the reduction of the resultant force R is stabilized, reaching zero.

The numerical data of this embodiment will now be described. The material of the stationary magnet roll 5 is the same as in the first embodiment, and each of the magnetic poles provides 600±50 Gausses. The magnet roll 5 has an outer diameter of 12 mm. The distance L=0.25 mm; l1 is 1.0 mm; and l2 is 0.5 mm. Under those conditions, the maximum deformation of the magnet roll 5 is 0.07 mm; and the magnetic field variation in the developing position is 20 Gausses. When the correcting magnetic members are removed from the structure of this embodiment, the deformation has been found to be 0.25 mm with the magnetic field variation of 80 Gausses. Thus, it has been confirmed that the significant improvement has been achieved.

The advantage of reinforcing the container is also provided in this embodiment.

As will be understood, the single correcting member of the first embodiment corresponds to a structure where the plural correcting members of the second embodiment are connected integrally, and therefore, the correcting function is preferably stabilized.

As described above, according to the present invention, the correcting member is disposed so as to balance the magnetic forces and the gravity applied to the magnet roll, thus greatly reducing the resultant force. Therefore, the deflection of the resin magnet is significantly reduced, and therefore, the vibration or non-uniform density of the image produced by the deformation is remarkably decreased. Thus, the performance of the developing device and the cleaning device is significantly improved.

As an additional advantage, the correcting member is effective to reinforce the developer container.

Particularly, the present invention is advantageous in view of the fact that, in order to meet the recent demand for reduction of size, weight and cost, a more flexible magnet roll is used, such as a magnet roll produced through a process wherein it is integrally formed without core metal from the mixture of magnetic powder and binder resin and then the magnetic particles are property directed and magnetized. This is because the problems solved by the present invention is a significant cause of insufficient development or insufficient cleaning. By the present invention, such a magnet roll becomes practically usable, and therefore, inexpensive, small and light apparatus as a whole can be provided with stabilized developing and cleaning operations.

According to the inventors' investigations, the deformation or deflection of the magnet roll is significantly large when the diameter of the resin magnet roll is not more than 20 mm. In that case, the variation in the magnetic field (magnetic flux density) in a certain region exceeds 100 Gausses, which prevents reduction of the apparatus size. When the present invention is used, the maximum deformation occurring in the middle of the length of the magnet roll can be reduced to not more than 0.1 mm; and the variation in the magnetic flux density is not more than 40 Gausses, even to the extent of not more than 20 Gausses. Therefore, a small diameter resin magnet roll is practically usable without inconvenience.

It is preferable that the reduced resultant force R is directed so that the resin magnet is pushed toward the portion where the development or cleaning operation is performed, since then the tolerance of the amount of deformation is wider than when the force R is directed otherwise. The force R effective to push the magnet toward the acting area can accommodate the possible errors resulting from variations in the manufacturing, and therefore, it is particularly advantageous in the case of mass-production. As shown in FIG. 1 it is preferable that the correcting member 8 has a surface substantially along the circumference of the non-magnetic sleeve 4, and the width is preferably not less than 7 mm.

The position where the correcting member is mounted is not particularly limited, if the resultant force is reduced and if the resin magnet is stabilized. For example, the correcting member of the magnetic material may be a part of the container. Furthermore, plural correcting members may be distributed in the circumferential direction, and in this case, the resultant force is stably reduced substantially to zero.

The correcting member of the magnetic material is employed in order to reduce the resultant force vector applied to the magnetic field generating means, and is not intended to limit or regulate the thickness of the developer layer on the non-magnetic sleeve. Therefore, the distance between the correcting member and the non-magnetic sleeve is preferably larger than the distance between the developer regulating member and the non-magnetic sleeve.

The correcting member may be a magnet, and it may be fixed to the part of the container of a resin material, and in this case, the correcting member is effective to reinforce the container.

Most often, the correcting member is disposed radially opposite to the developer layer regulating member. It is preferable that at least one of the correcting members or a part of the correcting member is disposed in the clearance formed between the non-magnetic sleeve and the bottom of the container, since then the developer in the container is prevented from leaking out through this clearance. The correcting member of the magnetic material may be a magnet.

The shape of the latent image bearing member is not limited, but may be a drum, belt or sheet.

The resin material constituting the resin magnet is preferably polyamide resin (nylon) when it is integrally formed with its shaft, and other examples of the resin material are synthetic resin, rubber or a mixture of two or more resin materials. More particularly, usable resin materials are rigid polyvinyl-chloride resin, polystyrene resin, polypropylene resin, styrene-acrylonitrile resin, ABS resin, polyacetal resin, polycarbonate resin, polyphenylene resin, polysulfone resin and the like.

Figure 5:
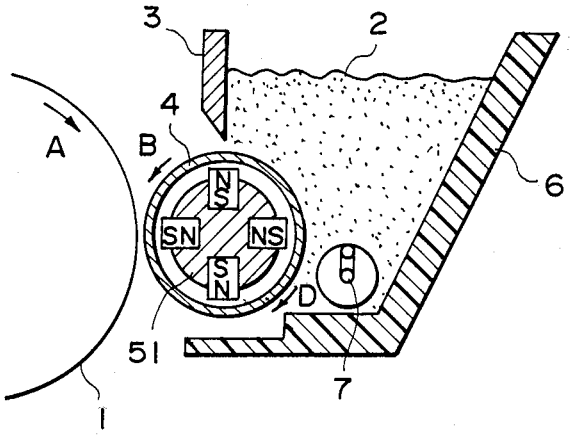
FIG. 5 PRIOR ART
FIG. 5 is a sectional view of a conventional developing apparatus.
Figure 7:
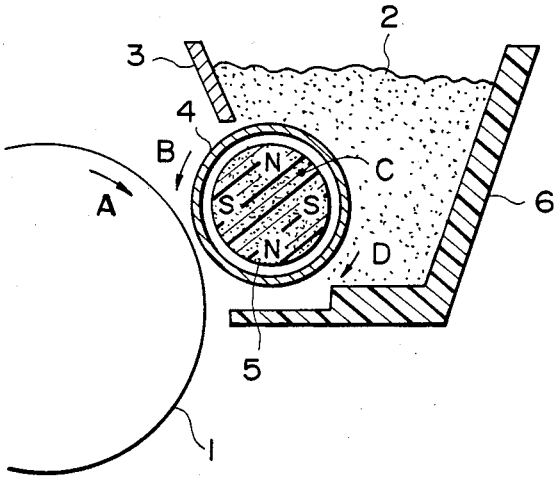
FIG. 7 is a sectional view of a developing apparatus incorporating a resin magnet without using the present invention.

Furthermore, it has been found that when the resultant force applied to the resin magnet roller (the vector sum of the gravity and the magnetic attraction forces applied thereto) is larger than 413 g (uniformly distributed load), the situation is similar to those shown in FIGS. 5 and 7, with the result of significant deformation of the roll. When the magnetic correcting member as described above is added, it has been confirmed that there is no practical problem if the resultant force is not more than 400 g (uniformly distributed load). Further investigation by the inventors have determined that when the resultant force is not more than 100 g (uniformly distributed load), the deformation is satisfactorily reduced even under the condition of relatively high temperature and humidity, and it is durable to the change of ambient conditions when, for example, the machine is transported. Further, when the resultant force is not more than 100 g, the clearance between the developer carrying sleeve 4 and the resin roll 5 can be decreased, whereby the magnetic flux density at the surface of the developer carrying surface 4 can be increased, and therefore, the diameter of the roll (4, 5) can be reduced.

The present invention covers any combination of the above described structures.

Figure 6:
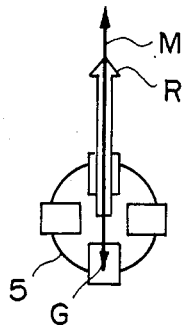
FIG. 6 illustrates forces applied to the magnet in the apparatus of FIG. 5.

Referring to FIGS. 5 and 6, the description will be made as to the reasons why the problems solved by the present invention have not been significant and have not been noted. Also, reference will be made to FIGS. 7 and 8 which illustrate the structure not using the present invention.

FIG. 5 is a sectional view of a developing apparatus of a conventional type. A sleeve 4 of non-magnetic material is disposed closely to a latent image bearing member 1 in the form of a drum. A stationary magnet roll 51 is disposed inside the sleeve 4 with a predetermined clearance and coaxially with the sleeve 4. The sleeve 4 and the magnet roll 51 are relatively rotatable. In the example of FIG. 5, the magnets 5 mounted on a reinforcing core metal are stationary, while the sleeve 4 rotates in the direction indicated by an arrow B. The magnetic developer (toner) 2 is attracted by the magnetic force by the magnet roll 5 and is deposited on the outer surface of the sleeve 4. The developer 2 is carried on the sleeve 4 rotating in the direction of the arrow B to the developing station where the latent image on the latent image bearing member is developed while the latent image bearing member is rotating in the direction of an arrow A.

In order to regulate the thickness of the layer of the developer on the sleeve 4, a blade 3 of magnetic material (developer regulating member) is disposed outside sleeve 4 with its end spaced from the outer surface of the sleeve by a predetermined clearance. Therefore, developer exceeding the predetermined amount is magnetically attracted and removed from the sleeve 4 by the magnetic blade 3, so that the predetermined thickness of the layer is maintained.

The developing apparatus further includes a stirring means 7 for stirring the developer 2 within the container 6.

As shown in FIG. 6, in the conventional apparatus, the resultant force R of gravity G applied to the magnet roll 51 and the magnetic attraction force between the magnetic blade 3 and the magnet roll 51, is fairly large. However, the magnet roll includes a rigid metal material so that no substantial influence results from the resultant force R. Therefore, in the conventional apparatus, the problems themselves on which the inventors focus, have not been recognized.

Figure 8:
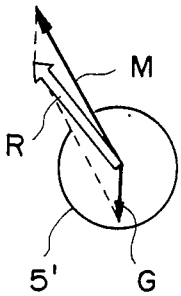
FIG. 8 illustrates forces applied to the resin magnet in the apparatus of FIG. 7.

FIG. 7 illustrates a structure which is similar to FIGS. 1 and 3 structures but without the correcting magnetic members 8, 81 and 82, the resultant force applied to the resin magnet 5 which is the vector sum of the gravity force G and the magnetic attraction force between the magnetic blade 3 and the magnetic pole N in the vicinity thereof, is large enough to deform the stationary resin magnet even to such an extent that the position of the magnetic pole S at the developing station is changed with the result of disturbance to the developing operation. FIG. 8 illustrates the resultant force R in the structure of FIG. 7. It will be understood that the problem arises in the structure of FIG. 7.

The present invention is most suitable to such a device wherein the magnetic developer is applied and carried thereon over the entire surface of the non-magnetic sleeve. However, the present invention is applicable to the case where two component developer is contained in the container, and only the toner particles are conveyed to the developing position. In such a case, the possible disturbance to the conveyance of the developer and the state of developer application can be prevented. In the foregoing description, the magnet 5 has four magnetic poles, but this is not limiting, and the present invention is applicable to the case where only the developing magnetic pole and the developer layer regulating pole are of resin magnet.

While the invention has been described with reference to the structures disclosed herein, it is not confined to the details set forth and this application is intended to cover such modifications or changes as may come within the purposes of the improvements or the scope of the following claims.

What is claimed is:

1. A device for conveying a magnetic developer, comprising:

a non-magnetic sleeve for carrying the magnetic developer;

a resin magnet stationarily disposed in said sleeve, said magnet being of a mixture of a resin material and a magnetic material, and extending in a direction of a length of said sleeve, said magnet having first and second magnetic field generating portions;

first and second magnetic members disposed outside said sleeve extending in the direction of the length of said sleeve, wherein said first and second magnetic members are spaced apart from each other and are so disposed that a magnetic force applied to said magnet by a magnetic force between the first magnetic field generating portion and said first magnetic member reduces a resultant force to said magnet by gravity and by a magnetic force between the second magnetic field generating portion and said second magnetic member.

2. A device according to claim 1, wherein said device is a developing device, and said first and second magnetic members are effective to maintain variation in the magnetic force at a developing position not more than 40 Gausses.

3. A device according to claim 1, wherein said magnet is a resin magnet roller as a whole including its shaft portion and is integrally formed from a mixture of the resin material and the magnetic material.

4. A device according to claim 1, wherein said magnet is a roller having a diameter not more than 20 mm.

5. A device according to claim 1, wherein said first magnetic member is a member for regulating a layer of the developer on the sleeve, and wherein said first magnetic member has a surface opposed to said first magnetic field generating portion which surface is larger than the first magnetic field generating portion with respect to a direction of the movement of the sleeve surface, the second magnetic member being disposed on a side of a container for containing a developer which is opposed to said sleeve, said first magnetic member being spaced from said sleeve.

6. A device according to claim 1, wherein said first magnetic member and said second magnetic member are substantially radially opposed with respect to an axis of said sleeve.

7. A device according to claim 3, wherein said device is a developing device, and said first and second magnetic members are effective to maintain variation of a magnetic force at a developing position not more than 20 Gausses.

8. A device according to claim 1, further comprising a third magnetic member disposed outside said sleeve extending in the direction of the length of said sleeve, said third magnetic member being effective to further reduce the resultant force.

9. A device according to claim 8, wherein said first magnetic member and said third magnetic member are connected to substantially constitute a single magnetic member.

10. A device according to claim 1, wherein said first and second magnetic members are spaced from the surface of the sleeve by not more than 3 mm.

11. A device according to claim 1, wherein maximum deformation of said magnet occurring adjacent to a longitudinal center thereof is not more than 0.1 mm.

12. A device according to claim 2, wherein a total resultant force which is a sum of the aforementioned resultant force and the force applied to said magnet by a magnetic force between the first magnetic member and the first magnetic field generating portion, is directed to the developing position.

13. A device according to claim 1, wherein said magnet is formed by an integral molding and having a shaft portion of the same material.

14. A device according to claim 1, wherein said second magnetic member acts on a magnetic developer carried on said carrying means, and said first magnetic member is a balancing member having a surface with a width larger than a width of the first magnetic field generating portion.

15. A device for conveying a magnetic developer, comprising:

means for carrying the magnetic developer on a surface thereof, wherein said carrying means comprises a resin magnet extending in a lengthwise direction of said carrying means;

first and second magnetic members stationarily disposed in facing relationship with said carrying means surface and extending in the lengthwise direction of said carrying means, wherein said first and second magnetic members are spaced apart from each other and are so disposed that a combined force to said magnet by a magnetic force between the first magnetic member and said magnet and by a magnetic force between the second magnetic member and said magnet substantially counterbalances the force of gravity on said magnet thereby to reduce a resultant force to said magnet by gravity and by the magnetic force between the first magnetic member and said magnet and by the magnetic force between the second magnetic member and said magnet.

16. A device according to claim 15, wherein said resin magnet contains polyamid resin as a major component.

17. A device according to claim 16, wherein said resin magnet contains contains vinyl chloride resin.

18. A device according to claim 15, wherein a variation of a magnetic force at a predetermined zone at which said magnet is influential is not more than 40 Gausses.

19. A device according to claim 18, wherein the variation is not more than 20 Gausses.

20. A device according to claim 15, wherein said second magnetic member is spaced apart from said surface of said carrying means with a first clearance and acts on a magnetic developer carried on said carrying means surface, while said first magnetic member is spaced apart from said carrying means surface with a second clearance larger than the first clearance.

* * * * *

UNITED STATES PATENT AND TRADEMARK OFFICE

CERTIFICATE OF CORRECTION

PATENT NO. : 4,743,942

DATED : May 10, 1988

INVENTOR(S) : AKIRA YAMAMOTO, ET AL.

It is certified that error appears in the above-identified patent and that said Letters Patent is hereby corrected as shown below: Title page:

AT [57] IN THE ABSTRACT

Line 15, "magnetic" (first occurrence) should read --magnet--.

COLUMN 3

Line 61, "magnetic roll 5," should read --magnet roll 5,--.

COLUMN 6

Line 51, "above described" should read --above-described--.

UNITED STATES PATENT AND TRADEMARK OFFICE

CERTIFICATE OF CORRECTION

PATENT NO. : 4,743,942

DATED : May 10, 1988

INVENTOR(S) : AKIRA YAMAMOTO, ET AL.

It is certified that error appears in the above-identified patent and that said Letters Patent is hereby corrected as shown below:

CLAIM 17

Line 10, "contains" (second occurrence) should be deleted .

Signed and Sealed this

Eighteenth Day of April, 1989

*Attest:*

DONALD J. QUIGG

*Attesting Officer*

*Commissioner of Patents and Trademarks*